US006457606B1

(12) United States Patent
Burke

(10) Patent No.: US 6,457,606 B1
(45) Date of Patent: Oct. 1, 2002

(54) METHOD AND DEVICE FOR INTRODUCING FLUID MATERIAL INTO A CLIMATE CONTROL SYSTEM

(75) Inventor: John Raymond Burke, New Baltimore, MI (US)

(73) Assignee: Bright Solutions, Inc., Troy, MI (US)

( * ) Notice: Subject to any disclaimer, the term of this patent is extended or adjusted under 35 U.S.C. 154(b) by 0 days.

(21) Appl. No.: 09/492,533

(22) Filed: Jan. 27, 2000

(51) Int. Cl.[7] ..... B67B 7/00
(52) U.S. Cl. ..... 222/1; 222/327
(58) Field of Search ..... 222/391, 326, 222/327, 386, 384, 1

(56) References Cited

U.S. PATENT DOCUMENTS

| | | | | |
|---|---|---|---|---|
| 1,716,482 A | | 6/1929 | Bradbury | |
| 1,926,399 A | | 9/1933 | Neilsen | |
| 1,984,865 A | | 12/1934 | Creveling | |
| 2,240,870 A | | 5/1941 | Starr | |
| 2,328,363 A | | 8/1943 | Sundholm | |
| 2,646,906 A | * | 7/1953 | Jones et al. | 222/391 |
| 2,732,102 A | * | 1/1956 | Ekins | 222/327 |
| 3,799,406 A | | 3/1974 | St. John et al. | 222/309 |
| 4,197,884 A | | 4/1980 | Maran | 141/383 |
| D263,635 S | * | 3/1982 | Wendt | D24/24 |
| 4,318,499 A | | 3/1982 | Hamilton | 222/327 |
| 4,339,058 A | * | 7/1982 | Wendt | 222/309 |
| 4,379,516 A | * | 4/1983 | Barlogis | 222/146 |
| 4,461,407 A | | 7/1984 | Finnegan | 222/391 |
| 4,467,620 A | | 8/1984 | Bradley et al. | 62/292 |
| 4,681,524 A | | 7/1987 | Ikeda et al. | 425/376 |
| 4,852,772 A | * | 8/1989 | Ennis | 222/386 |
| 4,925,061 A | * | 5/1990 | Jeromson | 222/1 |
| 4,938,063 A | | 7/1990 | Leighley | 73/40.7 |
| 4,941,520 A | | 7/1990 | Dowzall et al. | 141/114 |
| 4,948,016 A | | 8/1990 | Summons et al. | 222/158 |
| 5,027,605 A | | 7/1991 | Hardesty | 62/77 |
| 5,167,140 A | | 12/1992 | Cooper et al. | 73/40.7 |
| 5,386,931 A | * | 2/1995 | Jacobsen | 222/327 |
| 5,431,654 A | * | 7/1995 | Nic | 606/92 |
| 5,595,327 A | | 1/1997 | Dentler et al. | 222/327 |
| 5,673,722 A | | 10/1997 | Brass | 137/15 |
| 5,699,678 A | | 12/1997 | Trigiani | 62/292 |
| 5,826,636 A | | 10/1998 | Trigiani | 141/382 |
| 5,975,151 A | | 11/1999 | Packo | 141/3 |
| 5,979,224 A | | 11/1999 | Cavestri | 73/40.7 |
| 6,050,310 A | | 4/2000 | Trigiani | 141/382 |
| 6,056,162 A | | 5/2000 | Leighley | 222/156 |
| 6,155,066 A | * | 12/2000 | Chardler | 62/292 |

OTHER PUBLICATIONS

"Find Leaks Fast With The Tracker!", ROBINAIR Catalogue, © Robinair Division SPX Corporation, SA 792 (5/96), May, 1996.
"Hand Turn Dye Injectors", Classic Tool Design Inc. Catalogue © 1995 by Classic Tool Design Inc., 1995.
"A/C Leak Detection: The Next Generation", Viper Catalogue, Minneapolis, MN 00–996989 10/97, Oct., 1997.
"Cartridges" Genesis Industries, Incorporated, Elmwood, WI, (1992).
"Veterinary Applicator Model 408", Newborn Brothers & Company, Inc., Jessup, MD, (Nov. 1994).

* cited by examiner

*Primary Examiner*—John Kwon
*Assistant Examiner*—Melvin A. Cartagena
(74) *Attorney, Agent, or Firm*—Fish & Richardson P.C.

(57) ABSTRACT

The invention features a method and device for introducing fluid material into a climate control system. The fluid material can include a lubricant or a leak detection additive. The device includes a housing having an exit orifice and a housing holder having a trigger. Multiple doses of fluid material can be delivered to systems using the same housing. The method and device can allow a user to provide more economical, faster and cleaner service than with smaller volume systems, because, for example, less time is used to change the housing, eliminating or reducing contact with the fluid material and contamination of the work environment with the fluid material. The housing holder is compact and lightweight due to the absence of an external support structure holding the housing.

20 Claims, 3 Drawing Sheets

METHOD AND DEVICE FOR INTRODUCING FLUID MATERIAL INTO A CLIMATE CONTROL SYSTEM

BACKGROUND OF THE INVENTION

The present invention relates to a method and device for introducing fluid material into a climate control system, in particular an air conditioning system.

Leak detection additives can be used to detect leaks in fluid systems, such as climate control systems, hydraulic systems, engine oil systems, automatic transmission systems, fuel systems, brake systems, or radiator coolant systems. Climate control systems include heating, cooling, ventilating, and air conditioning systems. Some leak detection additives are emissive substances such as, for example, fluorescent or phosphorescent dyes. Suitable leak detection additives used in climate control systems include naphthalimide dyes, perylene dyes, thioxanthane dyes, coumarin dyes, or fluorescein dyes. Leaks can be detected by observing light emission from the dye at leak sites by exciting the dye with a light source having suitable wavelength or intensity. In general, the dyes fluoresce brightly when excited by light in the 190 to 700 nanometer wavelength range.

A variety of systems have been developed to introduce leak detection dyes into air conditioning systems. For example, previous injector designs include flow-chamber systems and syringe-type systems for introducing liquid dyes into the system. A flow-chamber system generally has a reservoir into which a leak detection dye solution is poured or a dye capsule is loaded and sealed. A carrier is then passed through the reservoir to transport the dye into the system. A syringe-type system generally has a chamber that is loaded by pouring the leak detection dye into the chamber or is preloaded by the manufacturer. The dye is then forced from the chamber into the closed system. Other injector systems include mist diffusers.

SUMMARY OF THE INVENTION

The invention features a method and device for introducing fluid material into a climate control system. The fluid material can include a lubricant or a leak detection additive. The device includes a housing having an exit orifice and a housing holder having a trigger. The housing can contain a large volume of fluid material relative to a controlled delivery volume of fluid material delivered from the device with a single motion of the trigger. The controlled delivery volume delivered to the system using the device is a relatively small portion of the large volume in a full housing. As a result, multiple doses of fluid material (e.g., up to 60 doses) can be delivered to systems using the same housing. Delivery of multiple doses of fluid material from the housing can result in more economical, faster and cleaner service than with smaller volume systems, because, for example, less time is used to change the housing. This can eliminate or reduce contact with the fluid material and contamination of the work environment with the fluid material. In addition, the exit orifice can be adapted to attach to many different fittings, adding to the flexibility of the system. The housing holder is compact and lightweight due to the absence of an external support structure to hold outer portions of the housing. Moreover, the size of the housing is not limited by the presence of an external support.

In one aspect, the invention features a fluid material delivery device. The device includes a housing having an exit orifice, a side wall, a movable plate within the housing in contact with the side wall, and a driver receiving end having a recessed region. The movable plate is externally accessible through the driver receiving end. The device also includes a housing holder having a handle, a trigger that moves relative to the handle, a housing receiver engaged with the driver receiving end, and a driver capable of moving the movable plate. The housing receiver includes a housing support substantially positioned within the recessed region and between the driver and the side wall. The driver includes a push rod attached to a pusher. The pusher is positioned within the driver receiving end and contacts the movable plate. The trigger is mechanically coupled to the driver such that the push rod moves the pusher and the movable plate when the trigger moves toward the handle. The device also includes a friction sleeve surrounding and slideably contacting the push rod within the housing holder and a stop that maintains the friction sleeve within the housing holder.

In another aspect, the invention features a housing holder of a fluid material delivery device. The housing holder has a handle, a trigger that moves relative to the handle, a housing receiver capable of engaging with a driver receiving end of a housing, and a driver capable of moving a movable plate of the housing. The housing receiver includes a housing support capable of being substantially positioned within a recessed region of the housing and between the driver and a side wall of the housing. The driver includes a push rod attached to a pusher. The pusher is capable of being positioned within the driver receiving end and capable of contacting the movable plate and the trigger being mechanically coupled to the driver such that the push rod moves the pusher when the trigger moves toward the handle. A friction sleeve surrounds and slideably contacts the push rod within the housing holder and a stop that maintains the friction sleeve within the housing holder.

The housing can include a locking tab. The housing receiver can include a locking lug. When the housing is engaged with the housing receiver, the locking tab is removably secured to the locking tab, for example, by twisting the housing into the housing receiver. The housing holder can include a compressible gasket between the driver receiving end and the housing receiver. The gasket can seal the housing to the housing holder. The exit orifice of the housing can be engageable with a high pressure side refrigerant port or a low pressure side refrigerant port. The exit orifice can include a one-way flow valve. The one-way flow valve can help prevent the system from pressurizing the housing due to internal system pressure. The housing can contain a lubricant or a leak detection additive, such as a naphthalimide dye.

The housing holder can include a handle and a trigger that moves relative to the handle. The driver can includes a push rod attached to a pusher. The pusher can be positioned within the driver receiving end, contacting the movable plate. The trigger is mechanically coupled to the driver such that the push rod moves the pusher and the movable plate when the trigger moves toward the handle. The trigger can be pivotally connected to the handle. In preferred embodiments, the housing holder can include a friction sleeve surrounding and slideably contacting the push rod within the housing holder. The housing holder can also include a stop that maintains the friction sleeve within the housing holder. The housing holder can contact the housing only at the driver receiving end.

In another aspect, the invention features a method of introducing a fluid material into a component of a climate control system. The method includes forcing the fluid material from the fluid material delivery device into the component. The fluid material exits the housing through the exit orifice. The method can include attaching the housing to the housing receiver by inserting the driver receiving end into the housing receiver and rotating the housing relative to the housing receiver to secure a locking tab of the housing with a locking lug of the housing receiver. In preferred embodiments, the method includes attaching the exit orifice of the housing to a high pressure side refrigerant port or a low pressure side refrigerant port of an assembled climate control system.

In another aspect, the invention features a leak detection kit including the housing, which can be loaded with a leak detection additive, a housing receiver, a hose assembly for attaching the housing to a climate control system, and a lamp, such as an ultraviolet lamp for detecting the leak detection additive. The kit can also include adapters for attaching the housing to a variety of systems and light filtering eye-wear that can help enhance detection of leaks. Examples of suitable lamps and eye-wear are described, for example, in U.S. Pat. Nos. 5,959,306, 5,742,066 and 5,674,000. The kit can be housed in a case.

Additional features and advantages of the invention will become apparent from the detailed description of the invention.

DETAILED DESCRIPTION OF THE PREFERRED EMBODIMENT

The method and device of the invention can be used to introduce fluid material, such as a lubricant or leak detection additive, into a climate control system. The climate control system can be a heating, ventilating, refrigeration, or air conditioning system. The air conditioning system can be a mobile (e.g., automotive, portable, residential), or commercial air conditioning system. The air conditioning system can be charged with a refrigerant, which can include hydrochlorofluorocarbons, hydrofluorocarbons, carbon dioxide, ammonia, halogenated or ether derivatives of methane or ethane, or halogenated ether or cyclic derivatives of propane, butane, pentane, or other hydrocarbons. The system can also include a lubricant.

Suitable fluid materials that can be introduced into climate control systems using the device and method of the invention include a lubricant, such as a polyalkylene glycol (e.g., a polyethylene glycol), mineral oil, alkyl benzene, polyvinyl ether, or a polyol ester or a leak detection additive. Other fluid materials can be delivered to other systems using the device, including: oils; transmission fluids; glues, epoxys and other adhesives; antifreeze; glycol; water; brake fluid; hydraulic oil; or fuel. The leak detection additive can include a naphthalimide dye, a perylene dye, a coumarin dye, a thioxanthane dye, or a derivative thereof.

Figure 1:
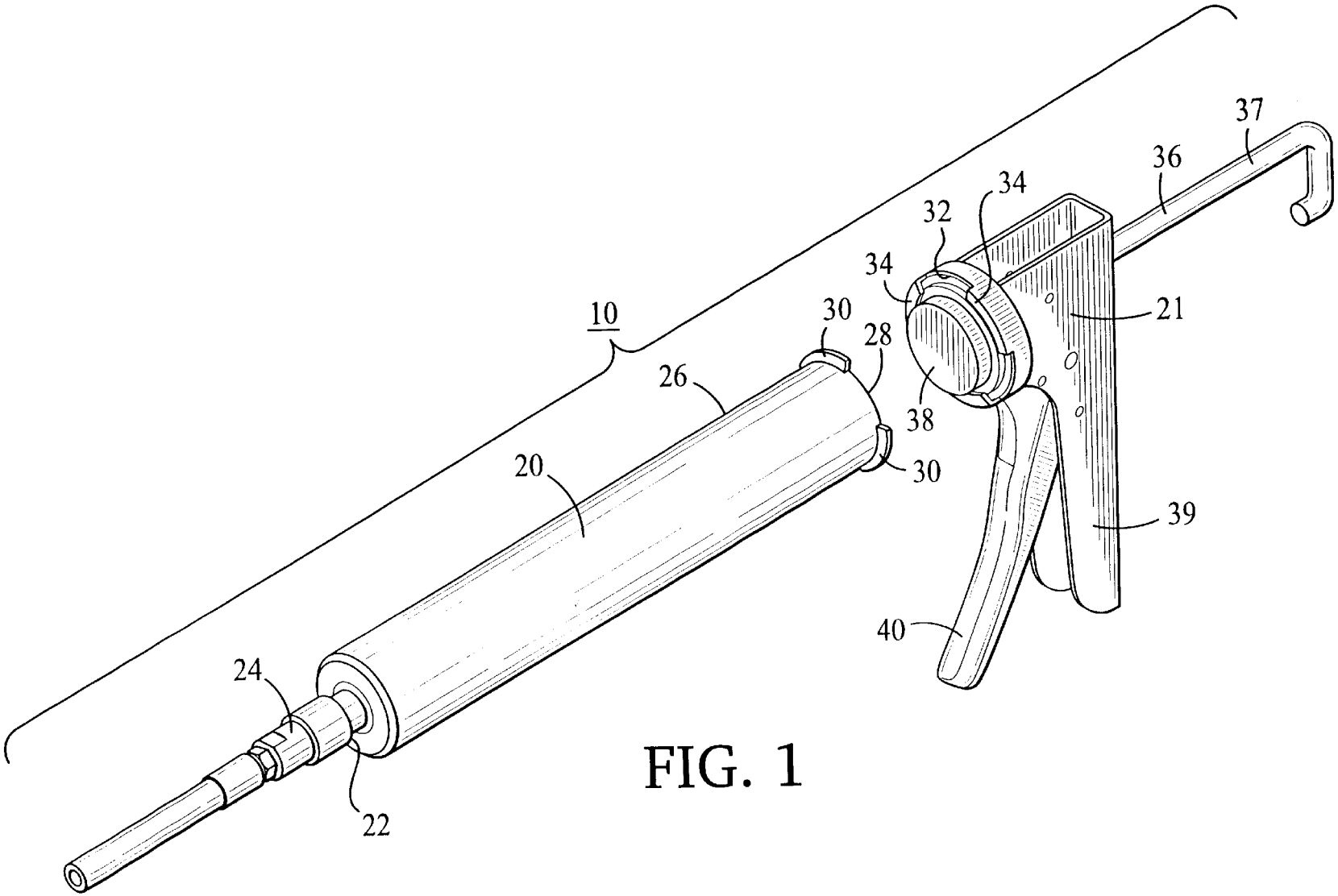
FIG. 1 is a perspective diagram depicting a housing and a housing holder.
Figure 2:
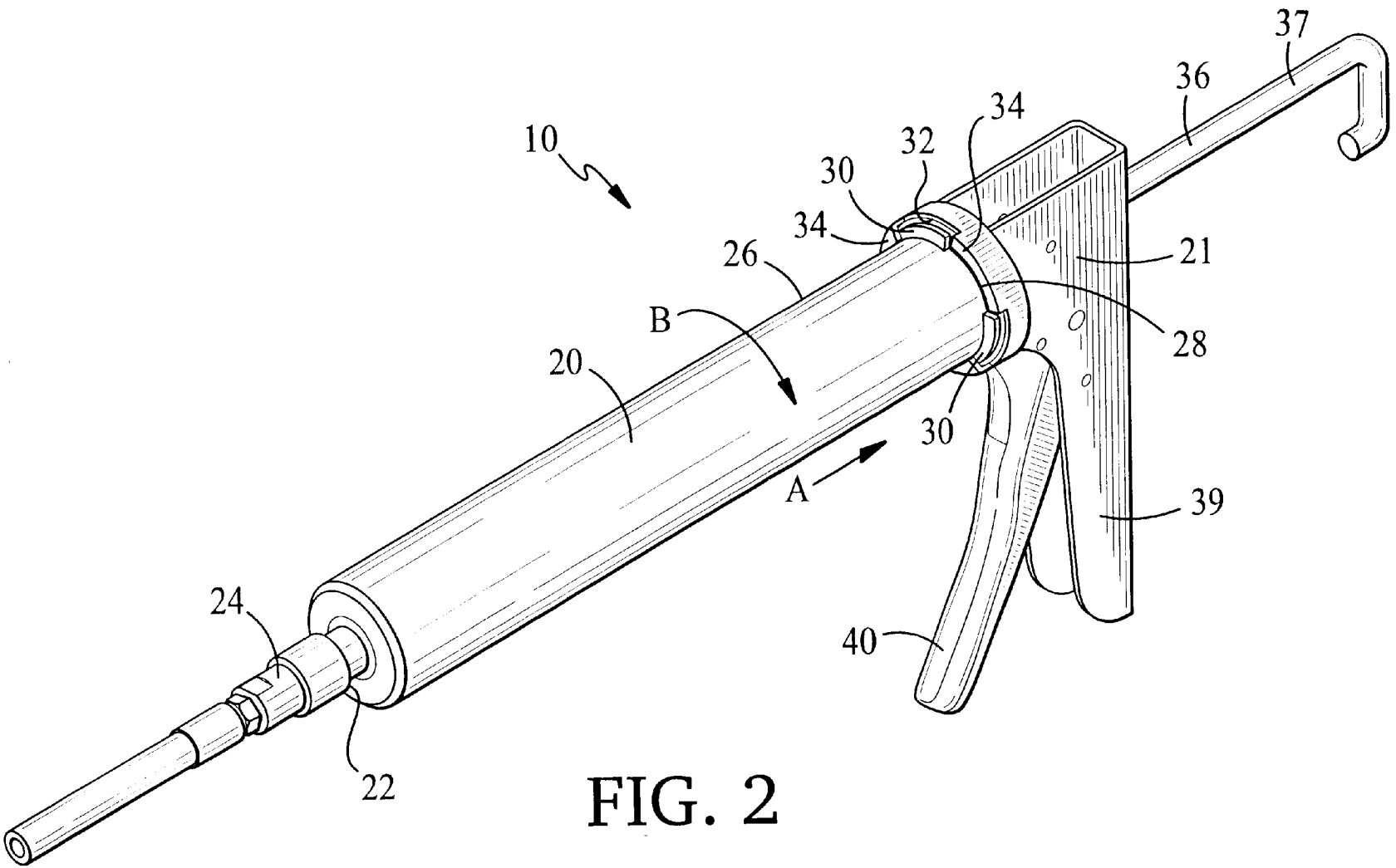
FIG. 2 is a perspective diagram depicting a fluid material delivery device.

Referring to FIGS. 1 and 2, fluid material delivery device 10 is constructed of housing 20 and housing holder 21. Housing 20 can be made of molded plastic, such as polyethylene or polypropylene. Housing 20 can be a single-use (disposable) or refillable cartridge. Housing 20 has exit orifice 22, through which the fluid material contained in housing 20 flows when the device is operated. Exit orifice 22 is engageable to the climate control system. In particular, exit orifice 22 can couple to a high pressure side refrigerant port or a low pressure side refrigerant port, for example, via a hose. By using various adapters, exit orifice 22 can couple to an R134*a* high side or low side port, a 14 mm connector, a 14 mm male port, a 14 mm female port, a ¼ inch male flare port, a ¼ inch female flare port, a ⅜ inch male flare port, a ⅜ inch female flare port, a ½ inch ACME male port, or a ½ inch ACME female port. Exit orifice 22 includes one-way flow valve 24. One-way flow valve 24 can be a check valve that prevents pressure in the system from backing up into device 10.

Figure 3:
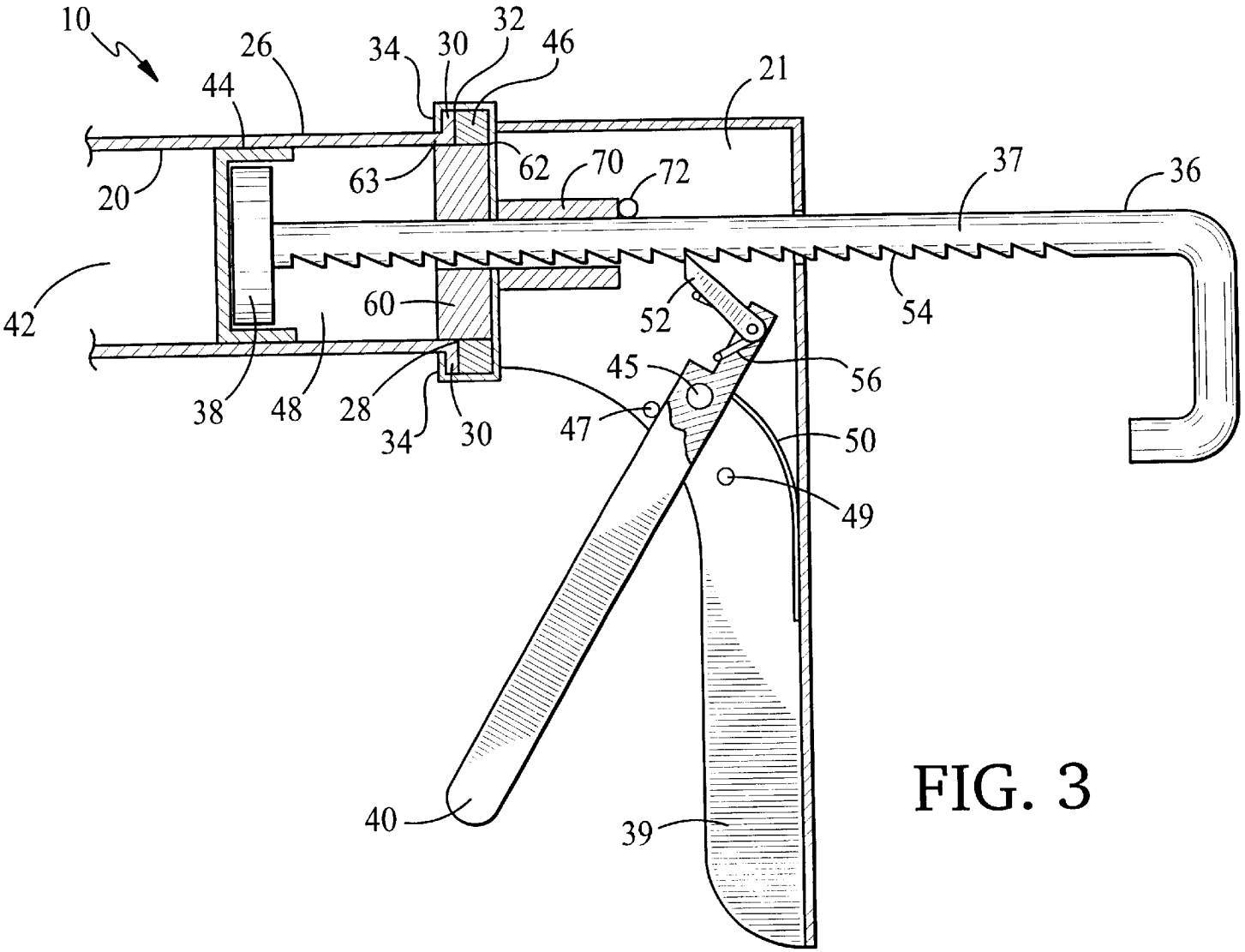
FIG. 3 is a schematic diagram depicting a cutaway view of a fluid material delivery device.

Referring to FIGS. 1–3, housing 20 also includes side wall 26 and driver receiving end 28. Locking tabs 30 are present at driver receiving end 28. Locking tabs 30 removably attach housing 20 to housing holder 21. Housing receiver 32 of housing holder 21 engages driver receiving end 28. Locking lugs 34 are part of housing receiver 32 that removably secures to locking tabs 30. As depicted in FIG. 2, when driver receiving end 28 is inserted into housing receiver 32 by the motion shown in arrow A, and housing 20 is then rotated relative to housing receiver 32 by the motion shown in arrow B, thereby securing housing 20 to housing receiver 32.

Housing holder 21 also includes driver 36 that is capable of forcing the fluid material from housing 20. Driver 36 has push rod 37 attached to pusher 38. Housing holder 21 includes handle 39 and trigger 40 that moves relative to handle 39, moving driver 36 toward housing 20. Housing holder 21 contacts housing 20 only at driver receiving end 28, allowing housing holder 21 to be compact and lightweight due to the absence of an external support structure to hold the housing. The size of housing can be constrained by the length of driver 36.

Referring to FIG. 3, housing 20 contains fluid material 42. Fluid material 42 is held in housing 20 by movable plate 44, which is located within housing 20, contacting and sealing with side wall 26. The seal between movable plate 44 and side wall 26 prevents fluid material 42 from leaking. Compressible gasket 46 forms a seal between driver receiving end 28 and housing receiver 32.

Driver receiving end 28 has recessed region 48 which allows movable plate 44 to be externally accessed. Driver 36 extends into recessed region 48 so that pusher 38 contacts movable plate 44. Driver 36 is capable of exerting pressure on and moving movable plate 44. Trigger 40 and handle 39 are pivotally attached via pin 45. Stop 47 and stop 49 limit the range of motion of trigger 40 with respect to handle 39. Spring 50 bias trigger 40 toward stop 47. Trigger 40 is mechanically coupled to driver 36 such that push rod 37 moves pusher 38 toward housing 20 when the trigger and handle assembly is squeezed.

The positions of stop 47 and stop 49 regulate the distance that pusher 38 can move, which thereby controls the amount of fluid material 42 that is forced from housing 20 during a single squeezing stroke. The positions of stop 47 and stop 49, and the diameter of housing 20 are selected so that a single squeeze of trigger 40 deposits sufficient leak detection additive in the system to detect leaks. Stop 47 and stop 49 are positioned so that a single, complete squeeze of the trigger expels ⅙ ounce of fluid material from housing 20. Housing 20 can contain 10 ounces of fluid material so that 60 applications of fluid material can be delivered from housing 20. Squeezing trigger 40 forces fluid material 42 from fluid material delivery device 10 and into a component of the climate control system.

When trigger 40 is moved toward handle 39, ratchet pawl 52 engages with ratchet teeth 54 on push rod 37, moving pusher 38 into housing 20. Ratchet pawl 52 is pivotally mounted to trigger 40 for releasable engagement with ratchet teeth 54. Spring 56 biases ratchet pawl 52 into engagement with ratchet teeth 54. Squeezing trigger 40 and handle 39 together causes driver 36 to move toward housing 20 and when trigger 40 is released, ratchet pawl 52 advances along ratchet teeth 54. Driver 36 can be reset by releasing ratchet pawl 52 from teeth 54, for example, by rotating push rod 37, and pulling rod 37 away from housing 20. Motion of pusher 38 toward housing 20 exerts pressure on movable plate 44, which forces fluid material 42 from housing 20 as trigger 40 moves toward handle 39.

Housing support 60 is positioned within the recessed region and between push rod 37 and side wall 26. Housing support 60 can assist in aligning housing 20 with driver 36. Outer edge 62 of housing support 60 is close to the inner portion of side wall 26. The clearance between outer edge 62 and side wall 26 is between about 0.005 inch and 0.030 inch, preferably between 0.010 inch and 0.020 inch. The clearance is less than the flange of locking tabs 30. Comer 63 of housing support 60 is even with or extends beyond locking lugs 34. The position of corner 63 and outer edge 62 hold housing 20 in place when pressure is being exerted by pusher 38 to force fluid material 42 from housing 20. When housing support 60 is not present, the pressure of pusher 38 allows side wall 26 of housing 20 to bend inward slightly, which causes locking lugs 34 and locking tabs 30 to slip or break. As a result, housing 20 can detach from housing holder 21. Slippage can occur at a pressure of about 30 psi. When housing support 60 was present so that comer 63 was even with locking lugs 34 and the clearance between outer edge 62 and side wall 26 was about 0.040 inch, pressures of 80 psi were tolerated without causing housing 20 to slip or break. When comer 63 extends beyond locking lugs 34, and the clearance is decreased, even higher pressures can be sustained. These increased operating pressures allow the device to deliver fluid materials to climate control systems cleanly and accurately, even with higher pressures in the system.

Housing holder 21 also includes friction sleeve 70, which surrounds and slideably contacts push rod 37. Stop 72 maintains friction sleeve 70 within housing holder 21. Push rod 37 slides through friction sleeve 70 when trigger 40 is squeezed. If ratchet pawl 52 is not engaged with teeth 54, friction sleeve 70 prevents movement of driver 36 by gravity.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method of introducing a fluid material into a component of a climate control system comprising:

forcing the fluid material from a fluid material delivery device into the component, the fluid material delivery device including a housing containing the fluid material and having an exit orifice, a side wall, a movable plate within the housing in contact with the side wall, and a driver receiving end, the movable plate being externally accessible through the driver receiving end, and a housing holder having a housing receiver engaged with the driver receiving end and a driver capable of moving the movable plate, the housing receiver including a housing support substantially positioned within a recessed region of the housing receiver and between the driver and the side wall, wherein the fluid material exits the housing through the orifice.

2. The method of claim 1, farther comprising attaching the housing to the housing receiver by inserting the driver receiving end into the housing receiver and rotating the housing relative to the housing receiver to secure a locking tab of the housing with a locking lug of the housing receiver.

3. The method of claim 1, wherein the housing holder includes:

a handle;

a trigger that moves relative to the handle;

a driver mechanically coupled to the trigger so that the driver moves relative to the handle when the trigger moves toward the handle, the driver including a push rod;

fiction sleeve surrounding and slideably contacting the push rod within the housing holder; and a stop that maintains the friction sleeve within the housing holder.

4. The method of claim 3, wherein forcing includes squeezing the trigger toward the handle.

5. The method of claim 4, wherein squeezing delivers ⅙ ounce of fluid material to the component.

6. The method of claim 1, wherein the housing holder includes a compressible gasket between the driver receiving end and the housing receiver.

7. The method of claim 1, further comprising attaching the exit orifice of the housing to a high pressure side refrigerant port or a low pressure side refrigerant port of an assembled climate control system.

8. The method of claim 1, wherein the fluid material contains a lubricant or a leak detection additive.

9. The method of claim 1, wherein the fluid material includes a naphthalimide dye.

10. A fluid material delivery device comprising:

a housing having an exit orifice, a side wall, a movable plate within the housing in contact with the side wall , and a driver receiving end, the movable plate being externally accessible through the driver receiving end;

a housing holder having a handle, a trigger that moves relative to the handle, a housing receiver engaged with the driver receiving end, and a driver capable of moving the movable plate, the housing receiver including a housing support substantially positioned within a recessed region of the housing receiver and between the driver and the side wall, and the driver including a push rod attached to a pusher, the pusher being positioned within the driver receiving end and contacting the movable plate and the trigger being mechanically coupled to the driver such that the push rod moves the pusher and the movable plate when the trigger moves toward the handle; and a friction sleeve surrounding and slideably contacting the push rod within the housing holder and a stop that maintains the friction sleeve within the housing holder.

11. The device of claim 10, wherein the housing includes a locking tab and the housing receiver includes a locking lug and the locking tab is removably secured to the locking tab.

12. The device of claim 10, wherein the housing holder includes a compressible gasket between the driver receiving end and the housing receiver.

13. The device of claim 10, wherein the exit orifice is engageable with a high pressure side refrigerant port or a low pressure side refrigerant port.

14. The device of claim 10, wherein the exit orifice includes a one-way flow valve.

15. The device of claim 10, wherein the housing holder contacts the housing only at the driver receiving end.

16. The device of claim 10, wherein the housing contains a lubricant or a leak detection additive.

17. The device of claim 10, wherein the housing contains a naphthalimide dye.

18. A housing holder of a fluid material delivery device comprising, a handle, a trigger that moves relative to the handle, a housing receiver capable of engaging with a driver receiving end of a housing, and a driver capable of moving a movable plate of the housing, the housing receiver including a housing support substantially positioned within a recessed region of the housing receiver and capable of being substantially positioned between the driver and a side wall of the housing, and the driver including a push rod attached to a pusher, the pusher capable of being positioned within the driver receiving end and capable of contacting the movable plate and the trigger being mechanically coupled to the driver such that the push rod moves the pusher when the trigger moves toward the handle, and a friction sleeve surrounding and slideably contacting the push rod within the housing holder and a stop that maintains the friction sleeve within the housing holder.

19. The housing holder of claim 18, wherein the housing receiver includes a locking lug removably engageable with a locking tab of the housing when the housing receiver is engaged with the driver receiving end.

20. The housing holder of claim 18, wherein the housing holder includes a compressible gasket that is compressed when the housing receiver is engaged with the driver receiving end.

* * * * *

UNITED STATES PATENT AND TRADEMARK OFFICE

CERTIFICATE OF CORRECTION

PATENT NO. : 6,457,606 B1
DATED : October 1, 2002
INVENTOR(S) : John Raymond Burke It is certified that error appears in the above-identified patent and that said Letters Patent is hereby corrected as shown below:

Column 6,
Line 25, change "fiction" to read -- a friction --.

Signed and Sealed this

Eighth Day of March, 2005

JON W. DUDAS
*Director of the United States Patent and Trademark Office*